US009285176B2

(12) United States Patent
Bentley

(10) Patent No.: US 9,285,176 B2
(45) **Date of Patent: *Mar. 15, 2016**

(54) MODULAR SHOTGUN BOX MAGAZINE

(71) Applicant: ADAPTIVE TACTICAL LLC, Nampa, ID (US)

(72) Inventor: James K. Bentley, Eagle, ID (US)

(73) Assignee: ADAPTIVE TACTICAL LLC, Nampa, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/624,450

(22) Filed: Feb. 17, 2015

(65) Prior Publication Data

US 2015/0308766 A1 Oct. 29, 2015

Related U.S. Application Data

(63) Continuation of application No. 14/259,525, filed on Apr. 23, 2014, now Pat. No. 8,966,801.

(51) Int. Cl.

| | |
|---|---|
| ***F41A 9/61*** | (2006.01) |
| ***F41A 9/64*** | (2006.01) |
| ***F41B 11/55*** | (2013.01) |
| ***F41A 9/65*** | (2006.01) |
| ***F41A 9/71*** | (2006.01) |

(52) U.S. Cl.
CPC ... *F41A 9/64* (2013.01); *F41A 9/65* (2013.01); *F41A 9/71* (2013.01); *F41B 11/55* (2013.01)

(58) Field of Classification Search
CPC ..... F41A 9/72; F41A 9/61; F41B 11/55
USPC ..... 42/49.01, 50
See application file for complete search history.

(56) References Cited

U.S. PATENT DOCUMENTS

| | | | | | |
|---|---|---|---|---|---|
| 1,044,983 | A | * | 11/1912 | Brown | 42/50 |
| 2,765,558 | A | * | 10/1956 | Roper et al. | 42/18 |
| 3,803,739 | A | * | 4/1974 | Haines et al. | 42/6 |
| 4,027,415 | A | * | 6/1977 | Stoner | F41A 9/67 206/3 |
| 4,127,954 | A | * | 12/1978 | Hausmann | 42/50 |
| 4,468,875 | A | * | 9/1984 | Harrison et al. | 42/50 |
| 4,589,218 | A | * | 5/1986 | Teppa | 42/50 |
| 4,901,463 | A | * | 2/1990 | Chesnut | 42/50 |
| 5,113,604 | A | * | 5/1992 | Vyprachticky | F41A 9/66 42/50 |

(Continued)

OTHER PUBLICATIONS

US Patent & Trademark Office, Office Action issued in U.S. Appl. No. 14/259,525, dated Aug. 1, 2014.

(Continued)

*Primary Examiner* — Samir Abdosh
(74) *Attorney, Agent, or Firm* — Parsons Behle & Latimer

(57) ABSTRACT

A modular shotgun magazine including an upper portion and a lower portion that are interchangeable with other upper and lower portions. The upper portion includes a first interior, and upper opening, a lower opening, and a lower flange. The lower portion includes a second interior with an upper opening and an upper flange. The upper flange of the lower portion is connected to the lower flange of the upper portion so that the first and second interiors form a cavity. A fastening mechanism selectively connects the upper portion to the lower portion. The upper portion of the modular magazine may be connected to various lower portions having different shell capacities. The lower portion of the modular magazine may be connected to different upper portions that are configured to mate with a receiver of different shotguns.

19 Claims, 5 Drawing Sheets

(56) References Cited

U.S. PATENT DOCUMENTS

| | | | | |
|---|---|---|---|---|
| 5,113,605 | A * | 5/1992 | Kim | 42/50 |
| 5,253,442 | A * | 10/1993 | Kim | F41A 17/38 42/50 |
| 5,279,059 | A * | 1/1994 | Howard | 42/90 |
| 7,941,955 | B2 * | 5/2011 | Stone | 42/50 |
| 8,418,390 | B1 * | 4/2013 | Wright | 42/49.01 |
| 8,607,489 | B1 * | 12/2013 | Calvert | F41A 9/71 42/49.01 |
| 2010/0126053 | A1 * | 5/2010 | Fitzpatrick et al. | 42/50 |
| 2010/0269389 | A1 * | 10/2010 | Lopez Laparra | 42/49.01 |
| 2010/0281737 | A1 * | 11/2010 | Cahill | F41A 9/65 42/50 |
| 2011/0167694 | A1 * | 7/2011 | Bigley et al. | 42/50 |
| 2011/0302816 | A1 * | 12/2011 | Fitzpatrick et al. | 42/50 |
| 2012/0066950 | A1 * | 3/2012 | Davidson | 42/50 |
| 2012/0167429 | A1 * | 7/2012 | Sullivan | 42/50 |

OTHER PUBLICATIONS

US Patent and Trademark Office, Final Office Action issued in U.S Appl. No. 14/259,525, dated Oct. 30, 2014.

* cited by examiner

MODULAR SHOTGUN BOX MAGAZINE

RELATED APPLICATIONS

This application is a continuation of U.S. patent application Ser. No. 14/259,525, entitled "MODULAR SHOTGUN BOX MAGAZINE" filed Apr. 23, 2014, which is hereby incorporated by reference in its entirety.

FIELD OF THE DISCLOSURE

The embodiments described herein relate to a modular box magazine that may be used with a shotgun. In one embodiment the modular box magazine comprises an upper portion and a lower portion. In some embodiments, the upper portion of the modular box magazine may be used with a lower portion of various sizes. For example, the same upper portion may be used with a five (5) shell lower portion, a ten (10) shell lower portion, a fifteen (15) shell lower portion, or a twenty (20) shell lower portion. In some embodiments, the lower portion of the modular magazine may be used with upper portions for various shotguns. For example, the lower portion may be used in connection with an upper configured for a MOSSBERG® shotgun or an upper for various other shotguns, such as a SAIGA® shotgun.

BACKGROUND

Description of the Related Art

There are numerous models and makes of shotguns. A large number of shotguns are adapted to be used with a magazine, such as a box magazine. Shotgun magazines come in various sizes with different shell capacities. In order to limit costs, a manufacturer of shotgun magazines may have to choose a select few shotguns for which to offer a magazine, since one magazine may be functional with only one make and/or model of shotgun. The manufacturer may need to purchase a mold for each shotgun magazine it would like to offer. A magazine manufacturer may also need to purchase a mold for each capacity configuration offered for a single model of magazine. The magazine manufacturer may offer a very limited number of different capacities in order to reduce manufacturing costs. Further, a single mold to produce a shotgun magazine may be very complex and require a large pull. Producing a modular shotgun magazine may permit a reduction of the pull for the complex portions and having separate molds for less complex components of the magazine assembly.

A shotgun user may own two or more shotguns that are different makes and/or models that are configured to be used with a box magazine. In order to use a magazine with each shotgun, the user may need to purchase two separate magazines as each magazine may only be compatible with a single make and/or model of a shotgun. The user may desire to own magazines having different shell capacities that may be used, depending on the intended activity. Thus, a user may need to buy multiple magazines for each make and/or model of shotgun with each of the desired shell capacities, some of which may not be utilized very often by the shotgun user.

SUMMARY

The present disclosure is directed to a modular shotgun magazine that overcomes some of the problems and disadvantages discussed above.

One embodiment is a modular shotgun magazine comprising an upper portion having a first interior, an upper opening, a lower opening, and a lower flange and a lower portion having a second interior with an upper opening and an upper flange. The upper flange of the lower position is positioned within the lower flange of the upper portion, the upper opening of the lower portion in communication with the lower opening of the upper portion so that the first interior and the second interior form a cavity. The magazine comprises a fastening mechanism to selectively connect the upper portion to the lower portion.

The fastening mechanism may be a plurality of fasteners positioned within a plurality of fastener openings in the lower flange. The magazine may include a mechanism positioned within the cavity to move a shell towards the upper opening of the upper portion. The cavity of the magazine may be configured to hold at least five shotgun shells or at least ten shotgun shells. The cavity of the magazine may be configured to hold a double stack of shotgun shells. The portion of the magazine may include a left half portion connected to a right half portion with a plurality of fasteners.

One embodiment is a system of a modular magazine for a shotgun comprising a first upper portion of a magazine having a first interior, an upper end of the first upper portion being configured to mate with a receiver of a first shotgun and a first lower portion of a magazine having a second interior. The system includes a first plurality of fasteners to selectively connect the first upper portion to the first lower portion, the first interior and the second interior form a cavity configured to hold a first number of shotgun shells.

The system may include a second lower portion having a third interior, the first plurality of fasteners selectively connect the second lower portion to the first upper portion in place of the first lower portion. The first interior and third interior may form a cavity configured to hold a second number of shotgun shells wherein the first number of shotgun shells differs from the second number of shotgun shells. The system may include a second upper portion having a fourth interior, the first plurality of fasteners selectively connect the second upper portion to the first lower portion in place of the first upper portion. The first interior and fourth interior form a cavity configured to hold a third number of shotgun shells. An upper end of the second upper portion may be configured to mate with a receiver of a second shotgun.

One embodiment is a method to provide a modular shotgun magazine comprising providing a first upper portion of a shotgun magazine, the first upper portion having a first interior, the first upper portion having an upper end configured to mate with a receiver of a first shotgun. The method comprises providing a first lower portion of a shotgun magazine, the first lower portion having a second interior and providing a connecting mechanism.

The method may include connecting the first upper portion to the first lower portion with the connecting mechanism, the first interior and second interior forming a cavity. The cavity formed from the first interior and the second interior may be configured to hold a first number of shotgun shells. The method may include providing a second lower portion of a shotgun magazine, the second lower portion having a third interior. The method may include removing the first lower portion from the first upper portion and connecting the first upper portion to the second lower portion with the connecting mechanism, the first interior and the third interior forming a cavity. The cavity formed from the first interior and the third interior may be configured to hold a second number of shotgun shells, wherein the second number may differ from the first number.

The method may include providing a second upper portion of a shotgun magazine, the second upper portion having a fourth interior, the second upper portion having an upper end configured to mate with a receiver of a second shotgun. The method may include removing the first upper portion from the first lower portion and connecting the second upper portion to the first lower portion with the connecting mechanism, the second interior and the fourth interior forming a cavity. The first shotgun may be from a different manufacturer than the second shotgun.

One embodiment is a modular magazine component comprising an upper portion having an interior, an upper opening, a lower opening, and a lower flange. The lower flange is configured to separately connect to at least two different lower portions to form two different magazine configurations.

One embodiment is a modular magazine component comprising a lower portion having an interior with an upper opening and an upper flange. The upper flange is configured to separately connect to at least two different upper portions to form two different magazine configurations.

Figure 1:
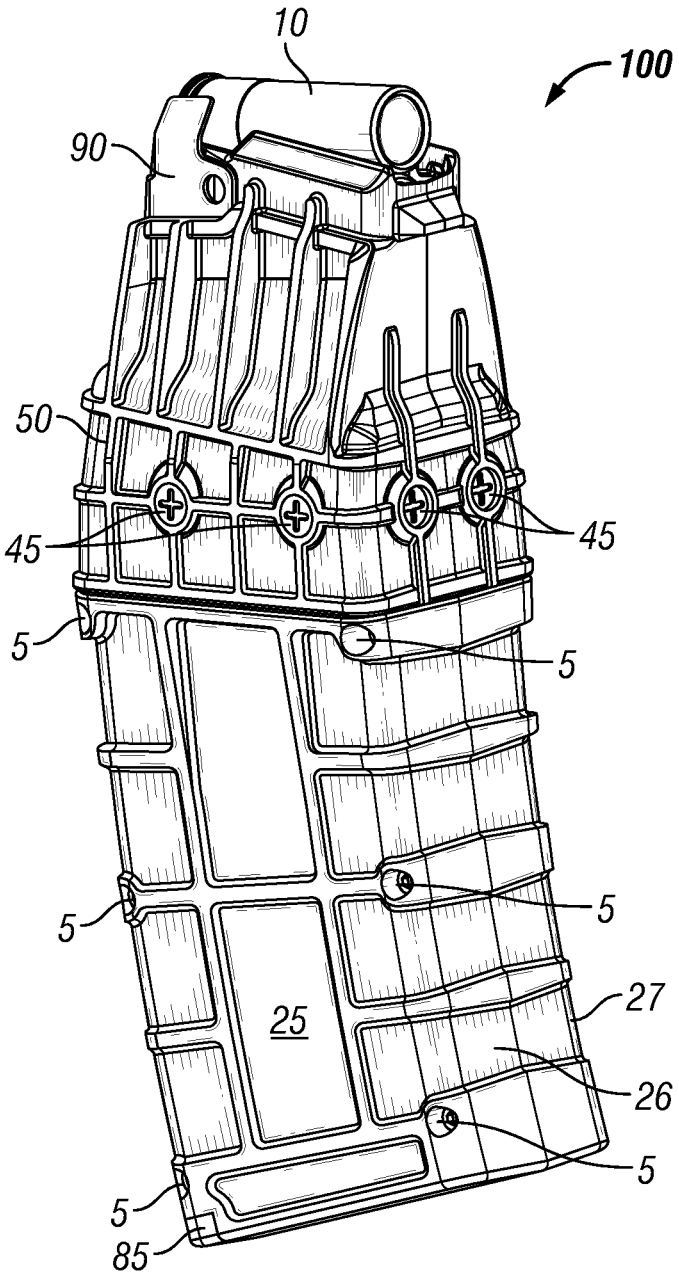
FIG. 1 shows an embodiment of a modular box magazine for a shotgun.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows an embodiment of a modular shotgun magazine 100. The magazine 100 comprises an upper portion 50 selectively connected to a lower portion 25 to hold a plurality of shotgun shells 10. Feed lips 90 may selectively retain the shotgun shells 10 within an interior 99 (best shown in FIG. 2) of the magazine 100. Various mechanisms may be used to selectively connect the upper portion 50 to the lower portion 25 as would be appreciated by one of ordinary skill in the art having the benefit of this disclosure. For example, a plurality of fasteners 45 may be inserted into openings 51 (best shown in FIG. 3) to selectively connect the upper portion 50 to the lower portion 25 to form the magazine 100. The lower portion 25 may be comprised of a first portion 26 and a second portion 27 connected together by a plurality of fasteners 5. A plate 85 may be used to cover a lower opening in the lower portion 25. The upper portion 50 is adapted to mate with a receiver of a particular type of shotgun and feed shotgun shells from the magazine 100 to the receiver. The modular magazine 100 permits the use of a lower portion 25 with various upper portions 50 that are adapted to be used in connection with different makes and models of shotguns as described herein. The modular magazine 100 also permits the user of an upper portion 50 with various lower portions 25 that are adapted to hold various numbers of shotgun shells, in connection with the upper portion, as described herein.

The modularity of the magazine 100 may result in a reduction of manufacturing costs that may be required to provide a line of magazines configured to be used with various shotguns. In order to provide a line of shotgun magazines having the different capacities of five (5) shells, ten (10) shells, and fifteen (15) shells, and offering these three different capacities for just four different makes of shotguns, a manufacturer may need twelve (12) different molds to produce each type of magazine. The modularity of the magazine 100 disclosed herein may reduce the number of molds to produce the example line of magazines to seven different molds, four molds for upper portions and three molds for lower portions. The lower portions 25 of the magazine 100 may be identical for each upper portion 50 regardless of make of the shotgun. The modularity of the magazine 100 also may reduce consumers' costs. For example, a consumer could purchase only a single complete magazine and two lower portions and have the same capacity capability as purchasing three complete magazines. The savings in consumer and vendor costs may increase as the different number of capacities and shotgun models increase.

Figure 2:
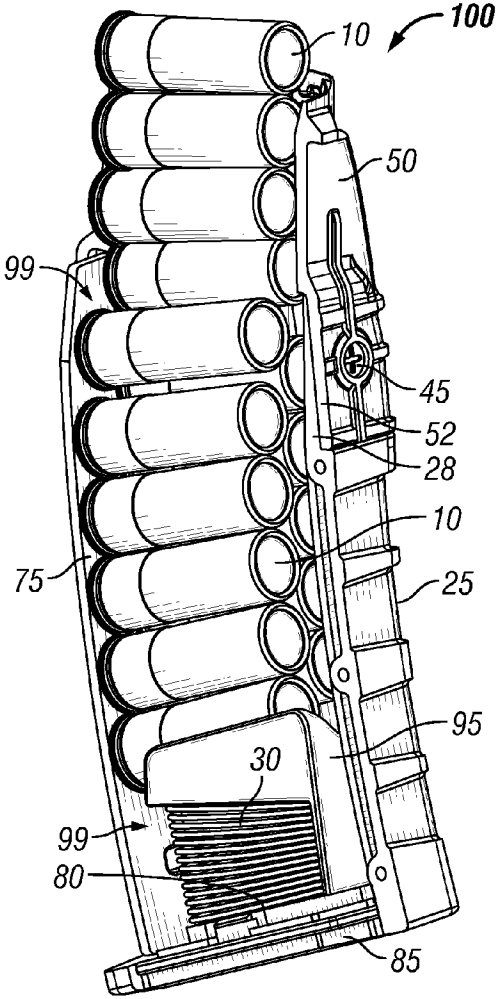
FIG. 2 shows a cutaway view of the modular box magazine of FIG. 1.

FIG. 2 shows a cutaway view of an embodiment of a magazine 100 that includes an upper portion 50 connected to a lower portion 25 via a plurality of fasteners 45. The interior 55 (shown in FIG. 3) of the upper portion 50 and the interior 29 (shown in FIG. 5) of the lower portion 25 combine to form a magazine cavity 99. The magazine cavity 99 may be configured to store a double stack of shotgun shells 10 as shown in FIG. 2. A floor plate 85 may cover a lower opening 23 in the lower portion 25 to enclose the magazine cavity 99. A spring loaded follower 95 advances shells 10 up the cavity and out of the opening 53 of the upper portion 50. The magazine 100 may include a spring plate 80 positioned between the floor plate 85 and the spring 30 connected to the follower 95. The magazine 100 may include a spacer 75 that permits the proper alignment of shells 10 up the magazine 100 even if various shell lengths are used. The flange 28 of the lower portion 25 is inserted within the flange 52 of the upper portion 50. Various mechanisms may be used to selectively connect the lower portion 25 to the upper portion. For example, fasteners 45 may be used to selectively secure the flanges 28 and 52 together to form the magazine assembly 100.

The magazine 100 may be adapted to permit the use of various lengths of shotgun shells 10 within the magazine 100. The magazine 100 stores the shotgun shells 10 in a double stack configuration and may include various mechanisms to convey the shotgun shells 10 from the magazine and into a receiver of a shotgun. For example, the magazine 100 may include a neck portion in which the shells 10 are in a single column, a double stack portion, and a transition portion that transitions shells 10 from a double stack to a single column as disclosed in U.S. Pat. No. 8,448,364 entitled Double Stack Box Magazine for Rimmed Cartridges of Varying Length to Michael J. Davidson, which is incorporated by reference in its entirety herein.

Figure 3:
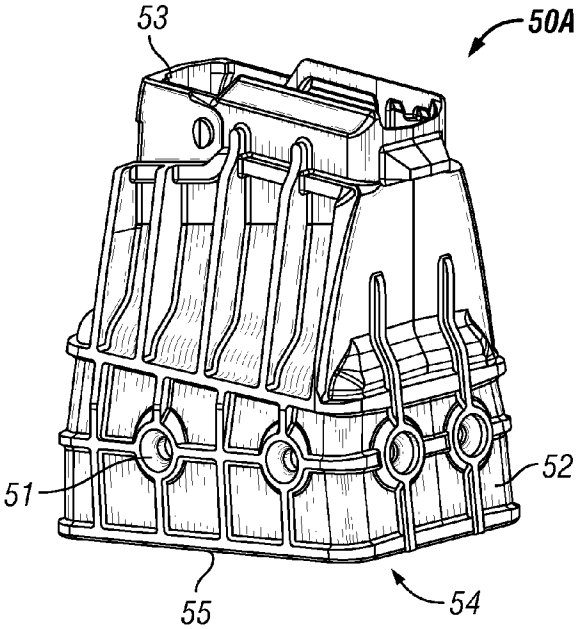
FIG. 3 shows a perspective view of an embodiment of an upper portion of a modular box magazine for a shotgun.

FIG. 3 shows an embodiment of an upper portion 50A that is adapted to be used with a particular make and/or model of a shotgun. For example, the upper portion 50A may be configured for use with a MOSSBERG® shotgun, but may not be operable with other makes of shotguns. The upper portion 50A includes a plurality of openings 51 in a lower flange 52 of the upper portion 50. The upper portion 50A includes a lower opening 54 and an upper opening 53 in communication with an interior 55. A shotgun shell 10 (not shown in FIG. 3) may exit the magazine cavity from opening 53 to be inserted into a receiver 200 (shown in FIG. 7) of a shotgun.

Figure 4:
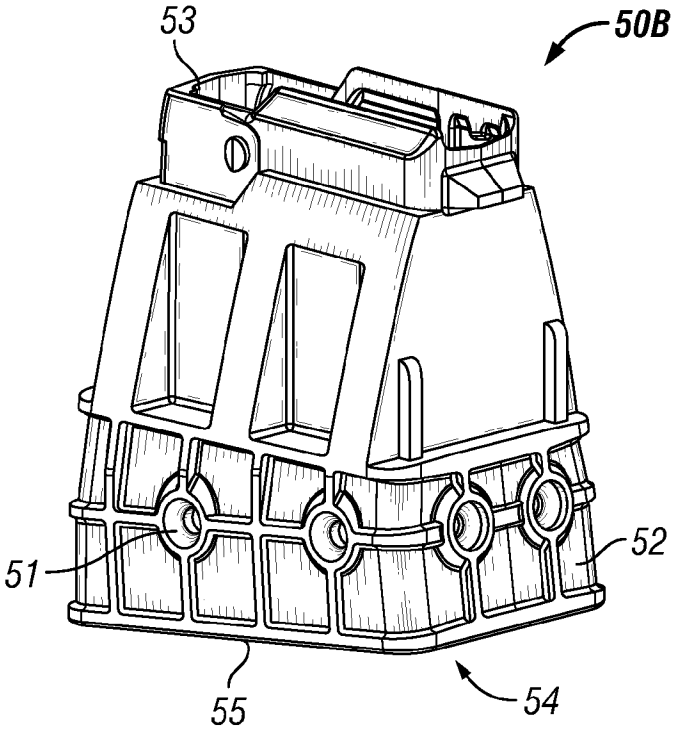
FIG. 4 shows a perspective view of an embodiment of an upper portion of a modular box magazine for a shotgun.

FIG. 4 shows an embodiment of an upper portion 50B that is adapted to be used with a particular make and/or model of a shotgun that differs from the make and/or model of the upper portion 50A shown in FIG. 3. The upper portion 50B is interchangeable with the upper portion 50A of FIG. 3 so that a magazine assembly 100 can be adapted to work with different shotgun makes and/or models. The same lower portion 25 can be attached to various upper portions 50. Thus, a user having many different shotgun models can use all lower portions 25 interchangeably with each shotgun only requiring the potential purchase of differently configured upper portions 50. The upper portion 50B includes a lower opening 54 and an upper opening 53 in communication with an interior 55. The upper portion 50B also includes a plurality of fastener openings 51 in the lower flange 52.

Figure 5:
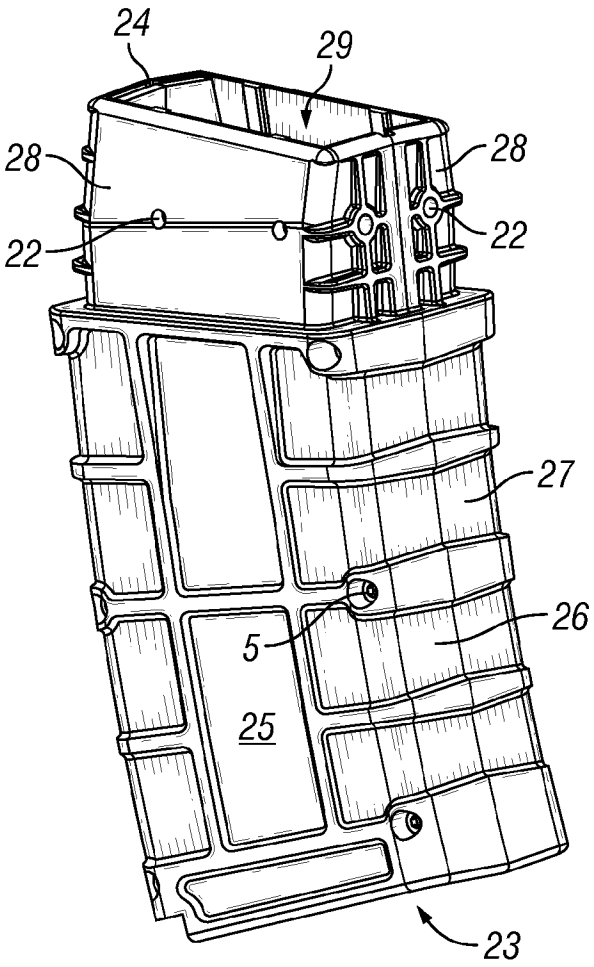
FIG. 5 shows a perspective view of an embodiment of a lower portion of a modular box magazine for a shotgun.

FIG. 5 shows an embodiment of a lower portion 25 that may be used with various upper portions 50. The lower portion 25 includes an upper flange 28 that may be inserted into a lower flange 52 of an upper portion 50. Fasteners 45 may then be used to selectively connect the flanges 28 and 52 together to form a magazine 100. The upper flange 28 includes a plurality of fastener openings 22 for the insertion of fasteners 45 (not shown in FIG. 5). The lower portion 25 may be comprised of two halves 26 and 27 connected together by a plurality of fasteners to form a lower portion 25. Alternatively, the lower portion 25 may be a single piece. The lower portion 25 includes an upper opening 24 and a lower opening 23 that are communication with an interior 29. The lower opening 23 may be covered by a plate 85 (shown in FIG. 1). Alternatively, the lower portion 25 may be formed with a closed lower end.

Figure 6:
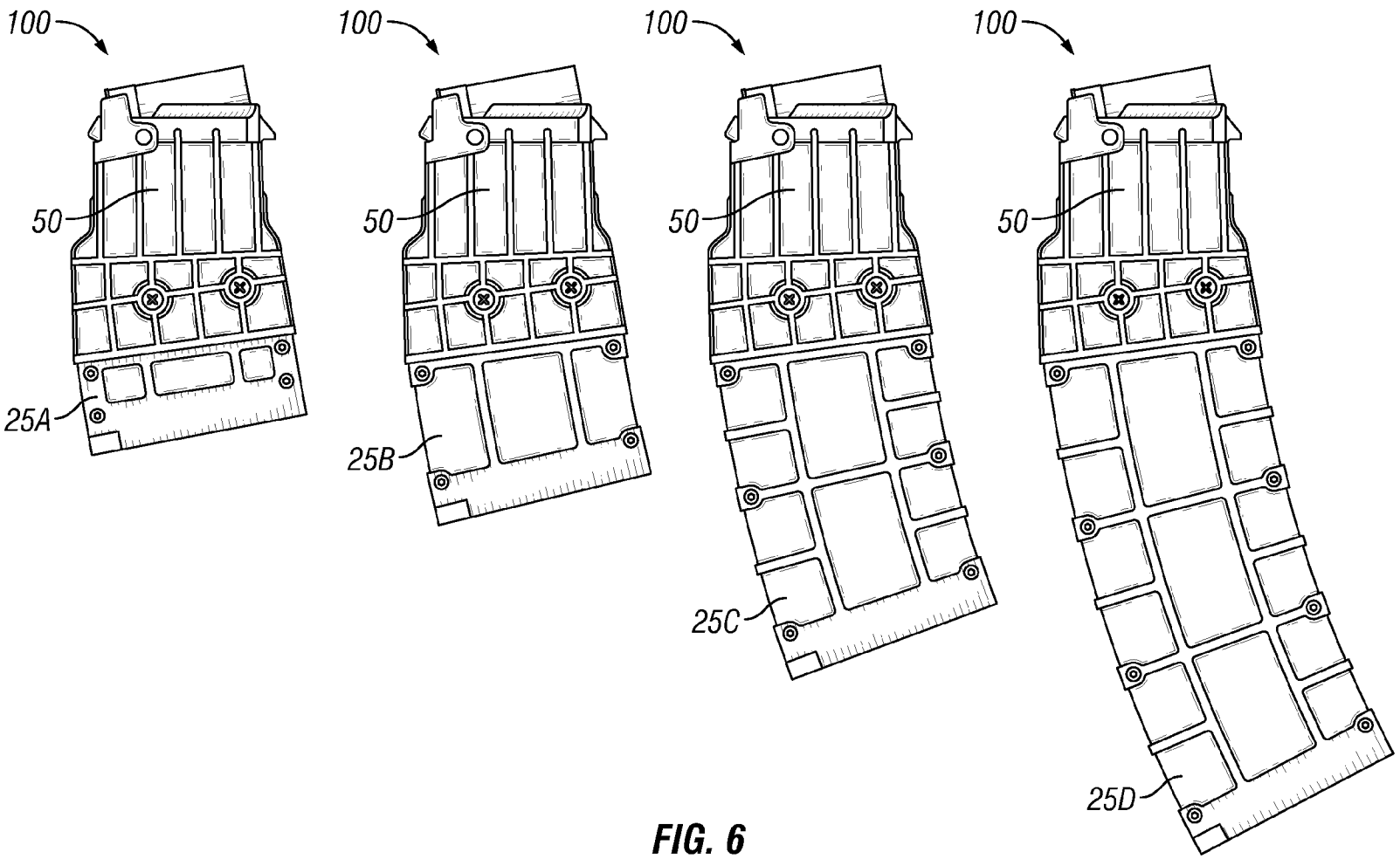
FIG. 6 shows various embodiments of lower portions of a modular box magazine for a shotgun.

FIG. 6 shows that the lower portions 25 may be produced in various configurations for the holding of shotgun shells 10 when connected to an upper portion 50 to form a magazine 100. One lower portion 25A may be configured to hold five (5) shells 10, another lower portion 25B may be configured to hold (10) shells 10, another lower portion 25C may be configured to hold fifteen (15) shells 10, while another lower portion 25D may be configured to hold twenty (20) shells 10. The number of shells held by the lower portions is for illustrative purposes only and may be varied as would be appreciated by one of ordinary skill in the art having the benefit of this disclosure. The modularity of the lower and upper portions 25 and 50 permits the user to purchase an entire magazine 100 and then only purchase components to later modify the magazine 100.

Figure 7:
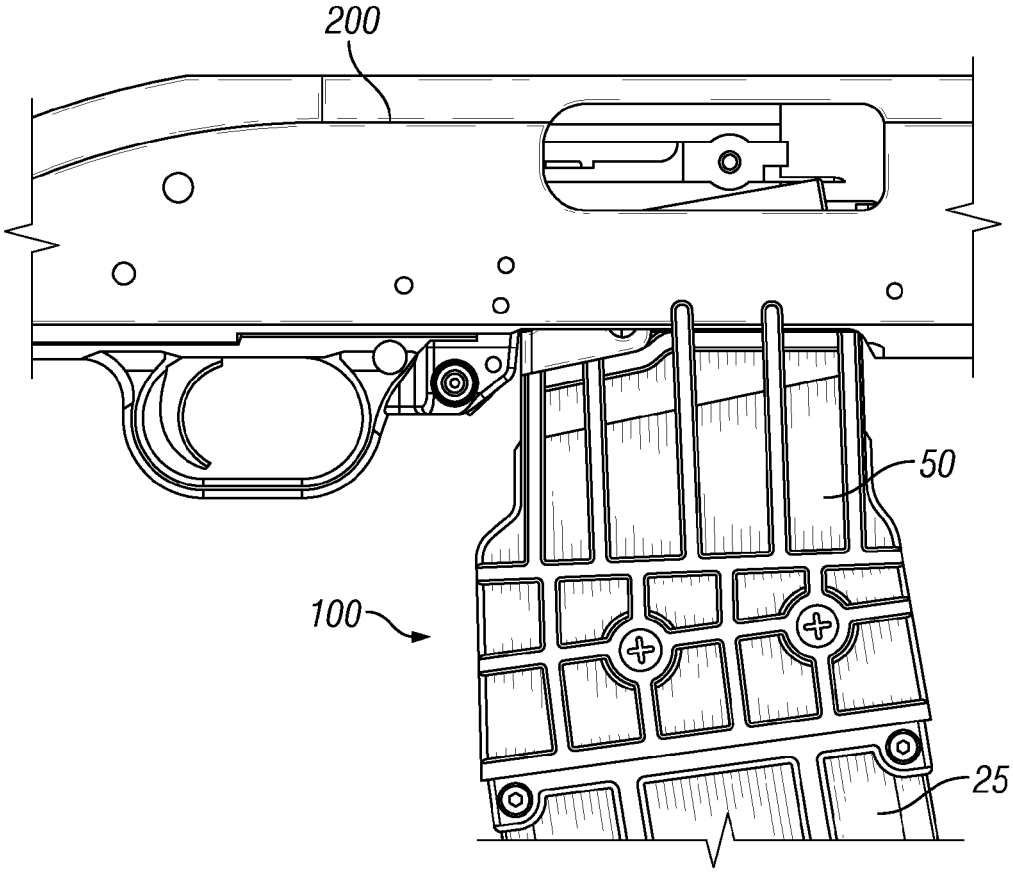
FIG. 7 shows an embodiment of a modular box magazine inserted into a receiver of a shotgun.

FIG. 7 shows a magazine 100 comprised of an upper portion 50 connected to a lower portion 25 inserted into a receiver 200 of a shotgun. The modularity of the magazine permits the same lower portion 25 to be detached and connected to a different upper 50 in the event the user decides to use a different shotgun with which the original upper is not configured to operate.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A modular shotgun magazine comprising:

an upper portion having a first interior, an upper opening, a lower opening, and a lower flange;

a lower portion having a second interior with an upper opening and an upper flange;

the upper flange of the lower portion being positioned within the lower flange of the upper portion, the upper opening of the lower portion in communication with the lower opening of the upper portion so that the first interior and second interior form a cavity; and a fastening mechanism to selectively connect and disconnect the upper portion and the lower portion, wherein the fastening mechanism prevents movement between the upper portion and the lower portion when the modular shotgun magazine is assembled.

2. The modular magazine of claim 1, wherein the fastening mechanism is a plurality of fasteners positioned within a plurality of fastener openings in the lower flange.

3. The modular magazine of claim 2, wherein the plurality of fasteners engage the upper flange of the lower portion.

4. The modular magazine of claim 2, wherein the plurality of fasteners prevent movement between the upper and lower portions in a direction normal to the lower opening of the upper portion.

5. The modular magazine of claim 4, wherein the plurality of fasteners may be removed from the fastener openings, the removal of the plurality of fasteners from the fastener openings selectively permits the separation of the upper portion from the lower portion.

6. The modular magazine of claim 1, further comprising a mechanism positioned within the cavity to move a shell towards the upper opening of the upper portion.

7. The modular magazine of claim 2, wherein the cavity is configured to hold at least five shotgun shells or at least ten shotgun shells.

8. The modular magazine of claim 1, wherein the cavity is configured to hold a double stack of shotgun shells.

9. The modular magazine of claim 1, the lower portion further comprising a left half portion connected to a right half portion with a plurality of fasteners.

10. A system of a modular magazine for a shotgun, the system comprising:

a first upper portion of a magazine having a first interior, an upper end of the first upper portion is configured to mate with a receiver of a first shotgun;

a first lower portion of a magazine having a second interior;

a first plurality of fasteners to selectively connect and disconnect the first upper portion and the first lower portion, the first interior and second interior form a cavity configured to hold a first number of shotgun shells, wherein the first plurality of fasteners prevents movement between the upper portion and the lower portion when the modular shotgun magazine is assembled.

11. The system of claim 10, further comprising a second lower portion having a third interior, the first plurality of fasteners selectively connect the second lower portion to the first upper portion in place of the first lower portion.

12. The system of claim 10, further comprising a second upper portion having a fourth interior, the first plurality of fasteners selectively connect the second upper portion to the first lower portion in place of the first upper portion.

13. A method to provide a modular shotgun magazine, the method comprising:

providing a first upper portion of a shotgun magazine, the first upper portion having a first interior, the first upper portion having an upper end configured to mate with a receiver of a first shotgun;

providing a first lower portion of a shotgun magazine, the first lower portion having a second interior; and providing a connecting mechanism configured to selectively connect and disconnect the first upper portion and the first lower portion, wherein the fastening mechanism prevents movement between the upper portion and the lower portion when the modular shotgun magazine is assembled.

14. The method of claim 13, further comprising connecting the first upper portion to the first lower portion with the connecting mechanism, the first interior and second interior forming a cavity.

15. The method of claim 13, wherein connecting the first upper portion to the first lower portion with the connecting mechanism further comprises inserting a plurality of fasteners into a plurality of fastener opening and rotating the plurality of fasteners to securely connect the first upper portion to the first lower portion.

16. The method of claim 13, wherein the cavity formed from the first interior and the second interior is configured to hold a first number of shotgun shells.

17. The method of claim 15, further comprising:

providing a second lower portion of a shotgun magazine, the second lower portion having a third interior;

removing the first lower portion from the first upper portion; and connecting the first upper portion to the second lower portion with the connecting mechanism, the first interior and the third interior forming a cavity.

18. A system of a modular magazine for a shotgun, the system comprising:

a first upper portion of a magazine having a first interior, an upper end of the first upper portion configured to mate with a receiver of a first shotgun;

a first lower portion of a magazine having a second interior;

a fastening mechanism to selectively connect and disconnect the first upper portion and the first lower portion, the first interior and second interior forming a cavity configured to hold a first number of shotgun shells; and a second lower portion having a third interior, the fastening mechanism selectively connecting the second lower portion to the first upper portion in place of the first lower portion, wherein the first interior and third interior form a cavity configure to hold a second number of shotgun shells and wherein the first number of shotgun shells differs from the second number of shotgun shells.

19. A modular shotgun magazine comprising:

an upper portion having a first interior, an upper opening, a lower opening;

a lower portion having a second interior with an upper opening;

the upper opening of the lower portion in communication with the lower opening of the upper portion so that the first interior and second interior form a cavity; and a fastening mechanism to selectively connect and disconnect the upper portion and the lower portion, wherein the fastening mechanism prevents movement between the upper portion and the lower portion when the modular shotgun magazine is assembled.

* * * * *